US007182629B2

(12) United States Patent
Zhang et al.

(10) Patent No.: US 7,182,629 B2
(45) Date of Patent: Feb. 27, 2007

(54) CONNECTOR FOR FLEXIBLE PRINTED CIRCUIT

(75) Inventors: Chi Zhang, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/123,350

(22) Filed: May 5, 2005

(65) Prior Publication Data

US 2006/0030206 A1 Feb. 9, 2006

(30) Foreign Application Priority Data

Aug. 6, 2004 (CN) ..... 2004 2 0078500

(51) Int. Cl.
*H01R 12/24* (2006.01)

(52) U.S. Cl. ..... 439/495

(58) Field of Classification Search ..... 439/495, 439/496, 70

See application file for complete search history.

(56) References Cited

U.S. PATENT DOCUMENTS 3,569,909 A * 3/1971 Garver ..... 439/353
5,501,610 A * 3/1996 Ikemoto ..... 439/498
5,688,143 A * 11/1997 McHugh et al. ..... 439/495
5,816,845 A 10/1998 Chishima et al.
6,004,156 A * 12/1999 Roque et al. ..... 439/495
6,206,723 B1 * 3/2001 Kunishi ..... 439/495
6,254,406 B1 * 7/2001 Chiu et al. ..... 439/142
6,276,958 B1 * 8/2001 Chih ..... 439/495
6,508,661 B1 * 1/2003 Yu ..... 439/495
6,517,367 B2 * 2/2003 Yamane ..... 439/260
6,551,128 B2 * 4/2003 Asai ..... 439/495
6,561,843 B1 * 5/2003 Ma et al. ..... 439/495
2002/0013086 A1 * 1/2002 Inoue ..... 439/495

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An connector (100) for a flexible printed circuit (FPC) includes a stationary housing (1) defining a mounting face (15) for mounted on a printed circuit board (PCB) and having a tongue plate (12) substantially parallel to the mounting face and spaced from the mounting face; a movable housing (4) detachably assembled to the first housing with its bottom face (46) substantially on the mounting face of the first housing, and its upper face (44) opposite to the tongue plate to define a cavity therebetween for receiving the FPC (6); and terminals (2) arranged on the tongue plate and projecting to the cavity to engage conductors on the FPC.

11 Claims, 6 Drawing Sheets

CONNECTOR FOR FLEXIBLE PRINTED CIRCUIT

BACKGROUND OF THE INVENTION

1. Field of the invention

The present invention relates to an electrical connector, and more particularly to an electrical connector for a sheet-like connection member such as a flexible printed circuit or cable (FPC), a flexible flat cable (FFC) and so forth. All of these cables and circuit will be generally referred to as "FPC". The instant invention relates to a contemporaneously filed application having the same title, the same applicants, the same assignee with the instant application.

2. Description of Related Art

U.S. Pat. No. 5,816,845 discloses a connector for a FPC comprising a stationary housing having a cavity with an insertion port through which the FPC is inserted into the cavity; metal terminals mounted on the housing and inserted into the cavity; and a slide housing displaceable relative to the housing between a completely-retained position and a provisionally-retained position. When the FPC is to be inserted into the cavity, the slide housing is displaced to the provisionally-retained position to be held in a stand-by position outwardly of the insertion port. After the FPC is inserted into the cavity, the slide housing is also inserted into the cavity to the completely-retained position, to hold the metal terminals in contact with the FPC. However, such a connector requires the stationary housing to provide a sufficient size of height to define a cavity to receive the FPC and the slide housing.

Thereby, to meet the ever-increasing requirement of minimization of electrical components, a connector with a lower profile for FPC is desired.

SUMMARY OF THE INVENTION

An object of the present invention is to provide an electrical connector that is decreased in size of height for a FPC.

Accordingly, to achieve the above object, a connector of present invention includes a stationary housing defining a mounting face adapted for mounted on a printed circuit board (PCB) and having a tongue plate substantially parallel to the mounting face and spaced from the mounting face; a movable housing detachably assembled to the first housing with its under surface substantially on the mounting face to the first housing, and its upper surface opposite to the tongue plate to define a cavity therebetween for receiving the FPC; and terminals arranged on the tongue plate and projecting to the cavity to engage conductors on the FPC.

Other objects, advantages and novel features of the present invention will become more apparent from the following detailed description of the present embodiment when taken in conjunction with the accompanying drawings.

DETAILED DESCRIPTION OF THE INVENTION

Figure 1:
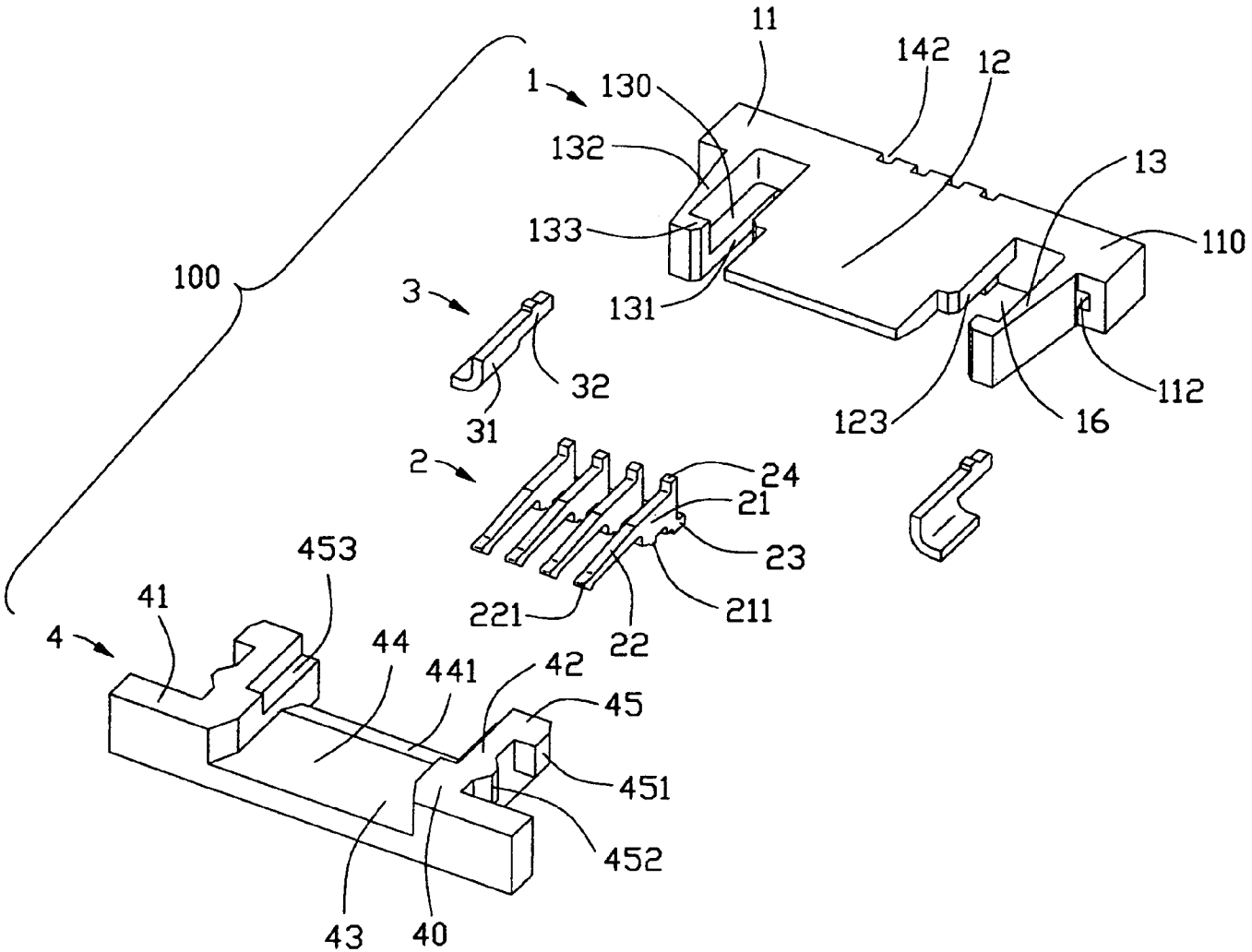
FIG. 1 is an exploded view of a connector of the present invention.

Reference will now be made to the drawing figures to describe the present invention in detail.

Figure 2:
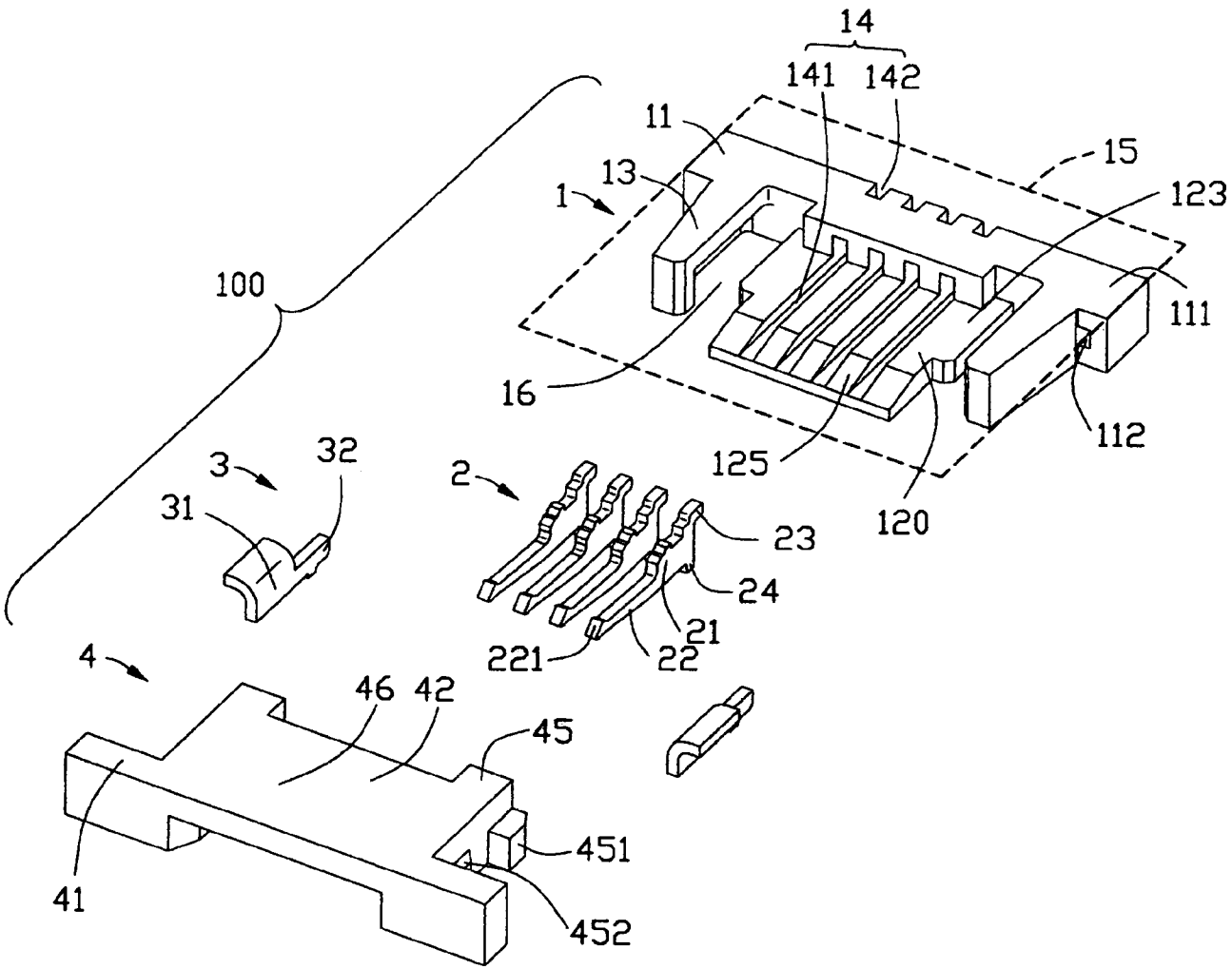
FIG. 2 is an exploded view of the connector of FIG. 1 but taken from reversed aspect.

Referring to FIGS. 1 and 2, the connector 100 of the present invention comprises a stationary housing 1, terminals 2 to be arranged in the stationary housing 1, retainers 3, and a movable housing 4.

Figure 5:
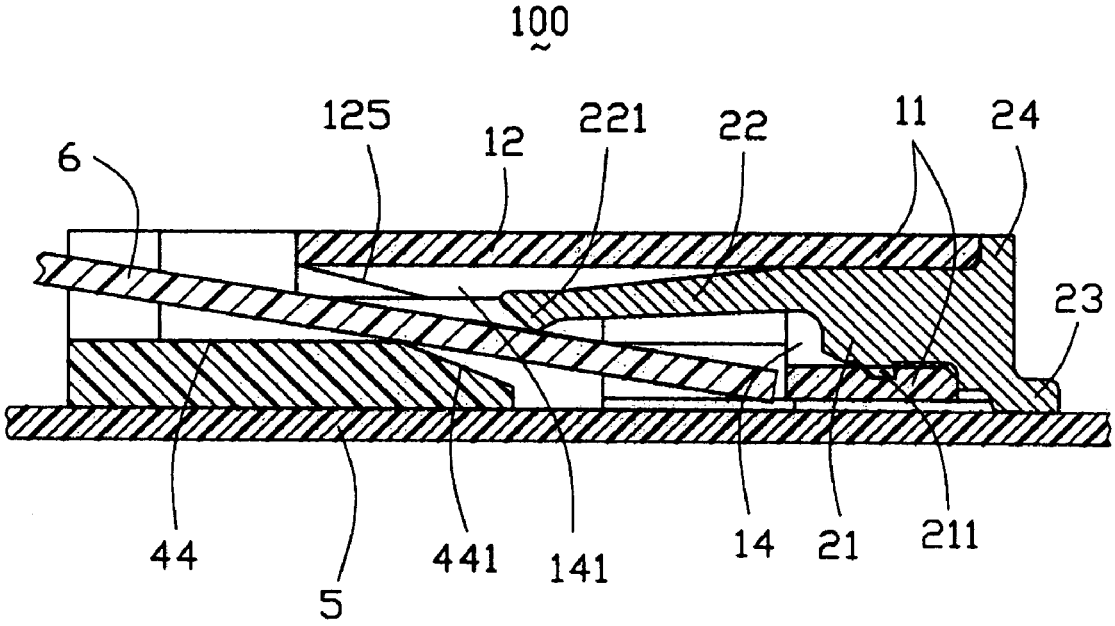
FIG. 5 is a cross-sectional view taken along line 5—5 of FIG. 3.

The stationary housing 1 has a lengthwise body portion 11, a tongue plate 12 breadthwise extending from the body portion 11 with its upper surface flush with an upper surface 110 of the body portion 11, and a pair of arms 13 oppositely beside the tongue plate 12 and extending from the body portion 11 with its upper surface and under surface respectively flush with the upper surface 110 and under surface 111 of the body portion 11. The under surface 111 of the body portion 11 defines a suppositional mounting face 15 for mounting on a printed circuit board (PCB). The tongue plate 12 has a first mating surface 120 facing the mounting face 15 with a vertical distance therebetween and defines a plurality of interior slots 141 on the first mating surface 120. Each interior slot 141 extends breadthwise throughout the body portion 11 to communicating a respective exterior slot 142 defined along a vertical direction, to form a unitary aperture 14 to receive the terminals 2. Additionally, the tongue plate 12 is trimmed to form a shortened edge 123. The first mating surface 120 inclines at that end remote from the body portion 11 to form a first slant 125, as best shown in FIG. 5. The arm 13 defines a recess 130 opening up and communicating with a space 16 between the arm 13 and the tongue plate 12.

The terminal 2 comprises a retain portion 21, an elastic arm 22 extending from one end of the retain portion 21, a solder tail 23 and a stop tail 24 respectively extending down and up from the other end of the retain portion 21. The elastic arm 22 has a contact portion 221 at the end thereof. The retain portion 21 has a retain leg 211 protruding downwards to be retained in the body portion 11 of the stationary housing 1.

Referring to FIG. 5 together, the terminal 2 is inserted into the aperture 14 from the exterior slot 142 with its elastic arm 22 received in the interior slot 141 and protruding towards the mounting face 15. The stop tail 24 is blocked in the exterior slot to stop the terminal 2 from moving ahead. The solder tail 23 is to be soldered to the PCB 5.

The retainers 3 each comprise an elbow 31 to be soldered to the PCB 5, and a leg 32 to be fixed into a hole 112 in the stationary housing 1 adjacent the outside of the arm 13 (shown in FIG. 1). Thus the retainers 3 retain stationary housing 1 to the PCB 5 to prevent the tongue plate 12 thereof from turning up during insertion of a FPC or the movable housing 4.

The movable housing 4 being of a "T" shape comprises a lengthwise body portion 41 and a mating portion 42 perpendicularly extending from the body portion 41, and is cut from an upper surface 40 thereof to define a passage 43 therein extending along a breadthwise direction throughout the body portion 41 and the mating portion 42. That bottom surface 44 of the passage 43 functions as a second mating surface and sidewalls 45 of the passage 43 function as slide legs. The second mating surface 44 declines at that end remote from the body portion 41 to form a second slant 441. Each slide leg 45 has a first slide block 451 and a second slide block 452 spaced protruding from its outer side, and defines a notch 453 by its inner side to engage the shortened edge 123 while the slide leg 45 is sliding into the space 16 of the stationary housing 1.

The movable housing 4 is assembled to the stationary housing 1 with an under surface 46 thereof sliding along the mounting face 15, the slide blocks 451,452 thereof being forced into the recess 130 in succession, and the notch 453 thereof fittingly engaging the shortened edge 123. Thus the slide blocks 451,452 are hold in the recess 130 by a bottom flange 131 thereof, to prevent the movable housing 4 from dropping down. The engagement of the notch 453 and the shortened edge 123 stops the movable housing 4 from moving up, thereby to keep a space between first mating surface 120 and the second mating surface 44 to form a cavity for receive the FPC. Otherwise, as the slide blocks 451,452 are hold in the recess 130, and are stopped from sidewalking by a side flange 132 thereof and from withdrawing by an end flange 133 thereof, the slide leg 42 therefore is retained in the space 16.

FIGS. 3 to 6 show the connector 100 being assembled and mounted on the PCB 5. Wherein the PCB 5 functions as a bottom wall of the stationary housing 1 to form a room together with the tongue plate 12 for receiving the FPC 6 and the movable housing 4. Thus a height size of the bottom wall is saved on the stationary housing 1. That decreases the whole height of the stationary housing 1.

Figure 3:
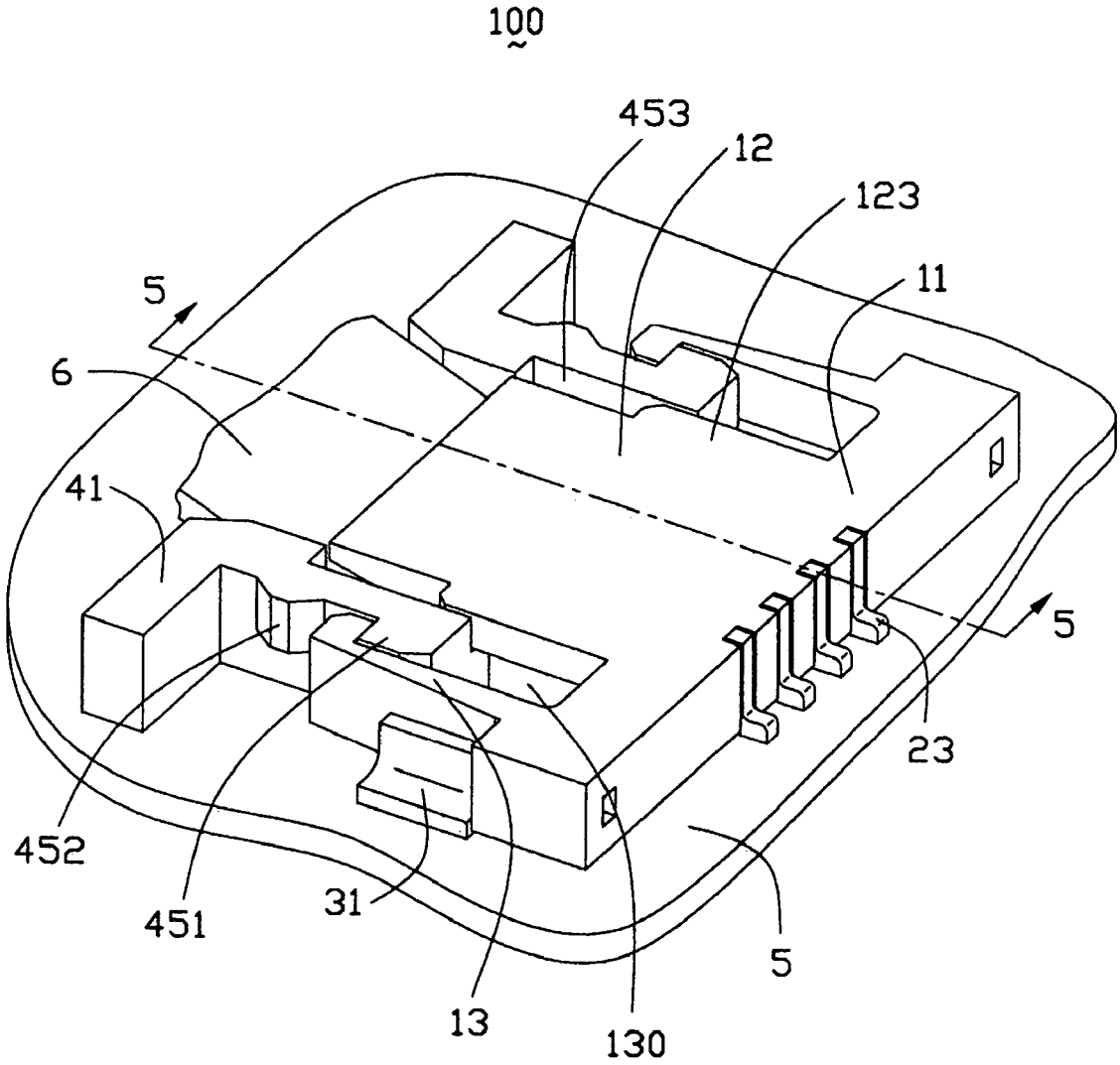
FIG. 3 is an assembled view of the connector of the present invention after being mounted on a printed circuit board, showing a movable housing in a provisionally-retained position relative to a stationary housing of the connector and a FPC being aslant inserted into the connector.

As shown in FIGS. 3 and 5, when the first slide block 451 is forced into the recess 451 but the second slide block 452 is still left out, the movable housing 4 is located in a provisionally-retained position relative to the stationary housing 1. At this time, the second slant 441 of the second mating surface 44 is brought into being parallel to the first slant 125 of the first mating surface 120 to form a slantwise insertion-port for guiding a FPC 6 to enter into the cavity between the first mating surface 120 and the second mating surface 44. Thus the FPC 6 is aslant inserted through the insertion-port with a zero insertion force. As a result of the insertion of the movable housing 4 or the FPC 6, the tongue plate 12 of the stationary housing 1 would be turned up if the stationary housing 1 is attached to the PCB 5 only by the terminals 2 therein being soldered to the PCB 5. However, the existence of the retainers 3 further retains stationary housing 1 to the PCB 5 against turning up of the tongue plate 12.

Figure 4:
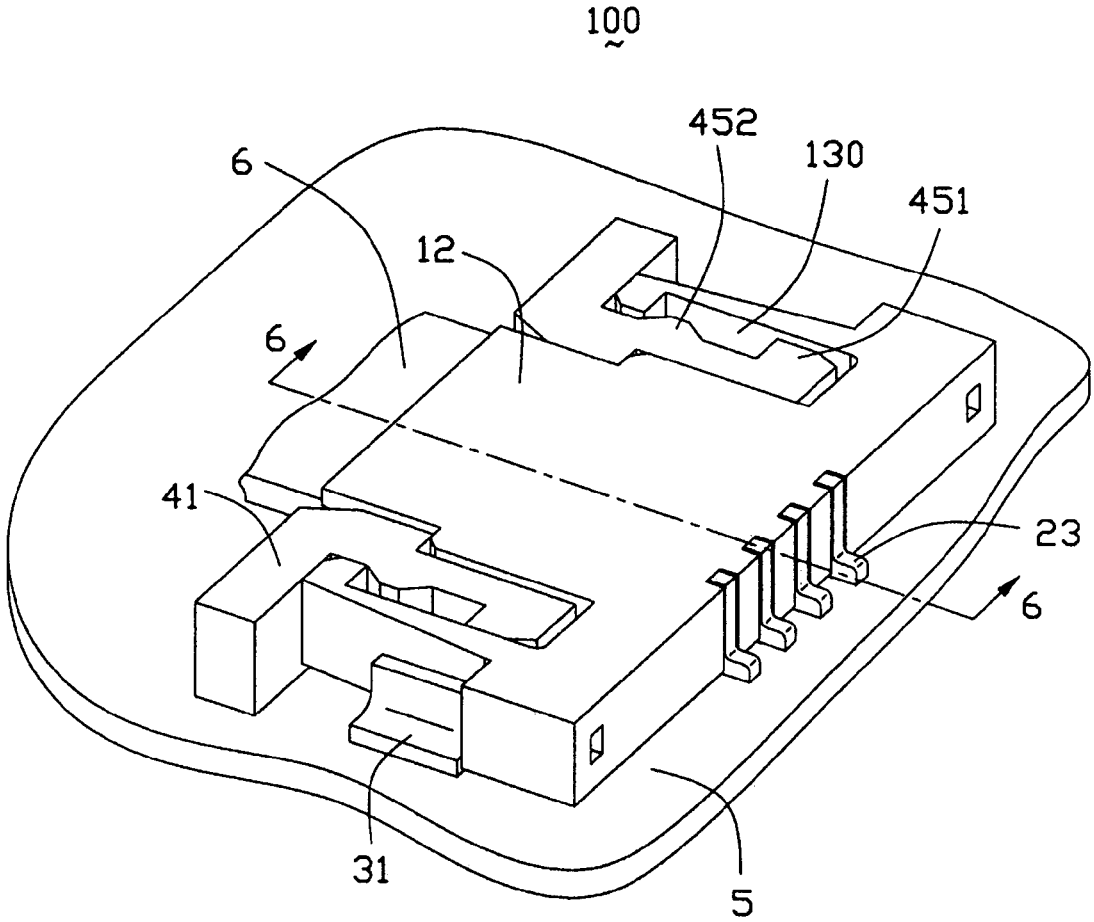
FIG. 4 is an assembled view of the connector of the present invention after being mounted on a printed circuit board, showing the movable housing in a completely-retained position relative to the stationary housing of the connector, wherein the FPC has been urged to contact terminals in the stationary housing.
Figure 6:
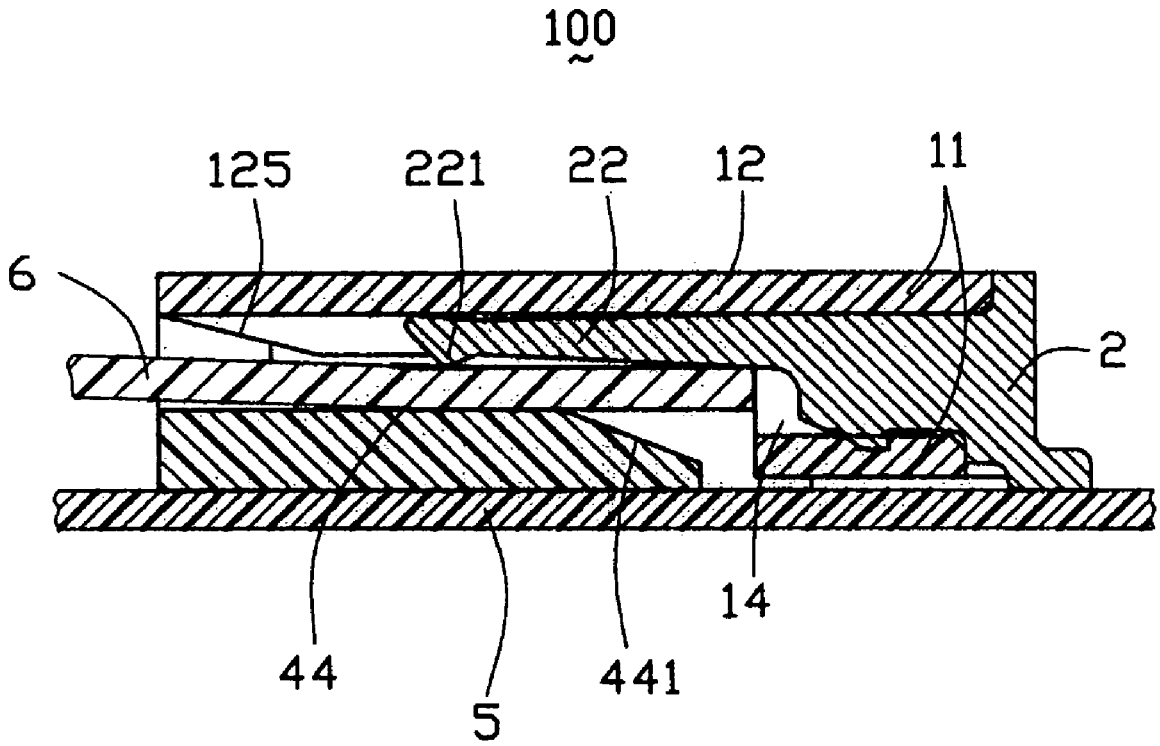
FIG. 6 is a cross-sectional view taken along line 6—6 of FIG. 4.

After the FPC 6 is inserted into the cavity, the movable housing 4 is further inserted towards the stationary housing 1, and the second slide block 452 is also forced into the recess 130. Now the movable housing 4 is in a completely-retained position, as shown in FIGS. 4 and 6. The second mating surface 44 of the advancing movable housing 4 urges the FPC 6 to rotate from the slanting state to a flat state to tightly contact the contact portions 221 of the terminals 2. That ensures electrical connection between conductors of the FPC 6 and the terminals 2.

Therefore, by such a design, an electrical connector with a lower profile for FPC is provided. However, the disclosure is illustrative only, changes may be made in detail, especially in matter of shape, size, and arrangement of parts within the principles of the invention.

The invention claimed is:

1. A connector assembly comprising:

a printed circuit board (PCB);

a first housing having a body portion mounted on the PCB, and a tongue plate projecting from the body portion and facing with and spaced from the PCB, the tongue plate having a plurality of terminals arranged thereon; and a second housing movably assembled to the first housing and defining an under surface adjacent to the PCB and an upper surface facing the tongue plate to define a cavity therebetween for receiving an FPC, the second housing being movable, generally along a front-and-back direction, relative to the first housing between a provisionally-retained position to let the FPC to enter the cavity and a completely-retained position to urge the FPC against the terminals to establish electrical connections therewith, wherein the first housing defines nothing between the tongue plate thereof and the PCB in a vertical direction perpendicular to the tongue plate.

2. An electrical connector assembly comprising:

a printed circuit board;

a stationary housing seated upon the printed circuit board and defining a mating tongue with a plurality of contacts therein, a pair of arms located by two sides of the mating tongue with a pair of recesses spaced from the mating tongue, respectively, each of said pair of recesses communicating with an exterior in both upward and forward directions; and a movable housing defining a mating portion with a pair of slide legs by two sides thereof, said movable housing defines opposite front and rear positions with regard to the stationary housing; wherein when assembled, the slide legs of the movable housing are received in the corresponding recesses, respectively, and movable between the opposite front and rear positions in a horizontal directions; wherein the stationary housing defines nothing located below the mating tongue in a vertical direction.

3. The electrical connector assembly as claimed in claim 2, wherein the mating tongue is located above the mating portion, when assembled.

4. The electrical connector assembly as claimed in claim 2, wherein each of the minis defines an enlarged head to prevent the corresponding slide leg from further forwardly moving away from the corresponding recess.

5. The electrical connector assembly as claimed in claim 2, wherein inter engagement occurs between the stationary housing and the moveable housing in said vertical direction, perpendicular to said horizontal direction, for retaining the movable housing to the stationary housing in said vertical direction when said slide leg is horizontally moveably received in the corresponding recess between said first and second positions.

6. The electrical connector assembly as claimed in claim 3, wherein noting, except said mating portion, is located between the mating tongue and the printed circuit board in said vertical direction.

7. The electrical connector assembly as claimed in claim 2, wherein the slide legs are upwardly exposed to the exterior.

8. The electrical connector assembly as claimed in claim 2, wherein the stationary housing defines nothing above the mating tongue in said vertical direction.

9. The electrical connector assembly as claimed in claim 2, wherein the contacts face downwardly toward the mating portion and the printed circuit board.

10. The electrical connector assembly as claimed in claim 1, wherein the second housing defines a mating plate located vertically between the tongue plate and PCB when assembled.

11. The electrical connector assembly as claimed in claim 1, wherein the terminals face downwardly toward the mating plate and the printed circuit board.

* * * * *